United States Patent [19]

Girecky et al.

[11] Patent Number: 4,917,378

[45] Date of Patent: Apr. 17, 1990

[54] PORTABLE INDOOR/OUTDOOR LOUNGE SWING

[76] Inventors: Janet L. Girecky; Frank D. Girecky, both of 202 E. Oak St., Kent, Ohio 44240

[21] Appl. No.: 349,415

[22] Filed: May 9, 1989

[51] Int. Cl.[4] ..... A63G 9/16; A63G 9/00

[52] U.S. Cl. ..... 272/85; 297/273; 297/278; 5/127; 5/130

[58] Field of Search ..... 272/85-92; 297/273-282, 433, 434; 5/120-130

[56] References Cited

U.S. PATENT DOCUMENTS

| | | | |
|---|---|---|---|
| 688,368 | 12/1901 | Waddel | 297/278 X |
| 1,405,768 | 2/1922 | Ekehorn | 297/278 |
| 1,932,959 | 10/1933 | Denman | 5/130 |
| 4,351,524 | 9/1982 | Gomes | 272/85 |

FOREIGN PATENT DOCUMENTS

| | | | |
|---|---|---|---|
| 1188309 | 9/1959 | France | 297/273 |
| 999733 | 7/1965 | United Kingdom | 272/85 |

*Primary Examiner*—Richard E. Chilcot, Jr.
*Attorney, Agent, or Firm*—Thomas M. Schmitz

[57] ABSTRACT

A recreational swing unit comprises a lounge swing adapted to be supported by chains to an overhead support structure. The lounge swing understructure contains quick disconnect snap-on connectors attached to the supporting chains to facilitate assembly or dismantling of the lounge swing relative to the overhead support structure. The preferred overhead structure is a free-standing, portable structure having Y-shaped vertical legs particularly adapted to stabilized the free-standing structure in use.

30 Claims, 3 Drawing Sheets

PORTABLE INDOOR/OUTDOOR LOUNGE SWING

BACKGROUND OF THE INVENTION

This invention relates to a recreational swing unit and more particularly to an indoor/outdoor lounge swing assembly comprising a family type lounge swing operatively suspended from an overhead supporting frame structure. The lounge swing is adapted to be easily assembled or dismantled for use in the yard or within the home.

Various types of conventional family type lounge swings are supported in use by support structures but unfortunately, can be unbalanced in use, are cumbersome to assemble, and are difficult to dismantle for storage purposes. For instance, quite often such swings utilize bolts or other permanent securing means to provide the necessary interconnections between the lounge swing and the supporting frame structure. Connectors to the swing itself as well as connecting means to the supporting structure must be disassembled and removed often causing partial dismantling of the swing or the supporting structure or both where such dismantling along with constant use subjects the swing assembly to unnecessary damage. Other recreational lounge swings are made for use outdoors or indoors, but do not have the versatility or portability to be useful for all seasons in the yard as well as in the home. Accordingly, it is highly desirable to provide a simplified swing assembly adapted to be easily assembled and conveniently portable for use outdoors or indoors.

It now has been found that a family lounge swing can be manufactured for indoor and/or outdoor use, which can be easily assembled and securely attached with minimal effort to an overhead support. The lounge swing understructure contains lateral supports fitted with snap-on connectors adapted to be easily snapped on to or removed from the understructure. The snap-on connectors enable supporting chains for the lounge swing to be securely connected to the snap-on connectors which eliminates the safety problem where inadvertent disconnection may occur during use. The supporting chains can be operatively interconnected to a permanent beam member secured inside the house or preferably interconnected to a free-standing, overhead supporting structure adapted to be freely movable for use inside or outside the house. The free-standing, overhead supporting structure can be easily assembled for use by securing a pair of A-frame type construction vertical leg members to both ends of an overhead supporting beam. In a preferred aspect of the invention, the overhead beam is fitted with permanently secured shoe clamps or slip brackets adapted to receive and secure each pair of vertical leg members in an A-shape construction to provide optimum balance and stability to the swing assembly during use. Further stability is provided in preferred aspects of the invention wherein each vertical leg member comprises a partially split and laterally spaced upper members adapted to slip fit into similarly laterally spaced shoe clamps secured to the overhead beam member. The laterally split upper leg members effectively distribute the downward and radially outward swinging forces and torques laterally along the overhead supporting beam thereby increasing the upright stability of the swing assembly against undesirable tipping in use. Each split upper leg member terminates in a lower unitary foot construction to provide increased strength and stability. In a further preferred aspect of the invention, a transverse portable shelf can be friction fitted between a pair of vertical leg members by engaging each vertical leg member between the split upper members to provide both a removable utility shelf and a transverse strut to further strengthen the A-frame leg members. The portable swing assembly is particularly useful inside the home such as in porches or dens or outside the home in the yard, at poolside, on the patio or even at campsites. These and other advantages of this invention will become more apparent by referring to the drawings and detailed description of the invention.

IN THE DRAWINGS

DETAILED DESCRIPTION OF THE INVENTION

Figure 1:
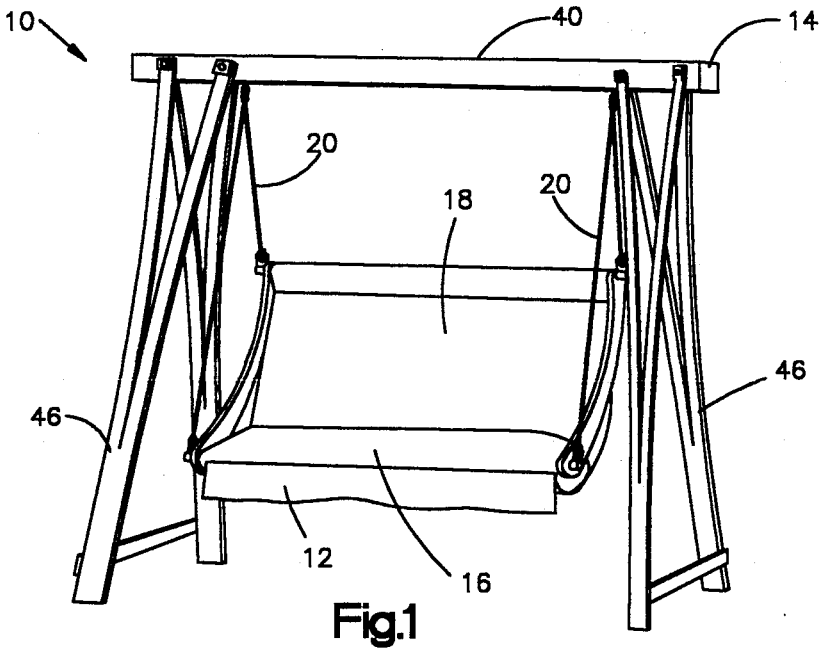
FIG. 1 is a front perspective view of the lounge swing supported by a free-standing, overhead frame to provide the swing assembly of this invention.

Referring now to the drawings where like reference characters designate like parts, shown in FIG. 1 is an indoor/outdoor lounge swing assembly 10 comprising a lounge swing 12 operatively suspended from an overhead, free-standing supporting structure 14. The swing 12 comprises a lounge seat 16 and a backrest 18 supported by a frame understructure suspended by a plurality of hanging chains 20 operatively interconnecting four corners of the swing 12 to the overhead supporting structure 14. The chains 20 can comprise four connecting chains where each interconnects with the overhead structure 20 as shown in the drawings or comprise shorter lead chains where each pair of lead chains is secured by an E-connector to a single chain interconnecting with the overhead structure 14.

Figure 2:
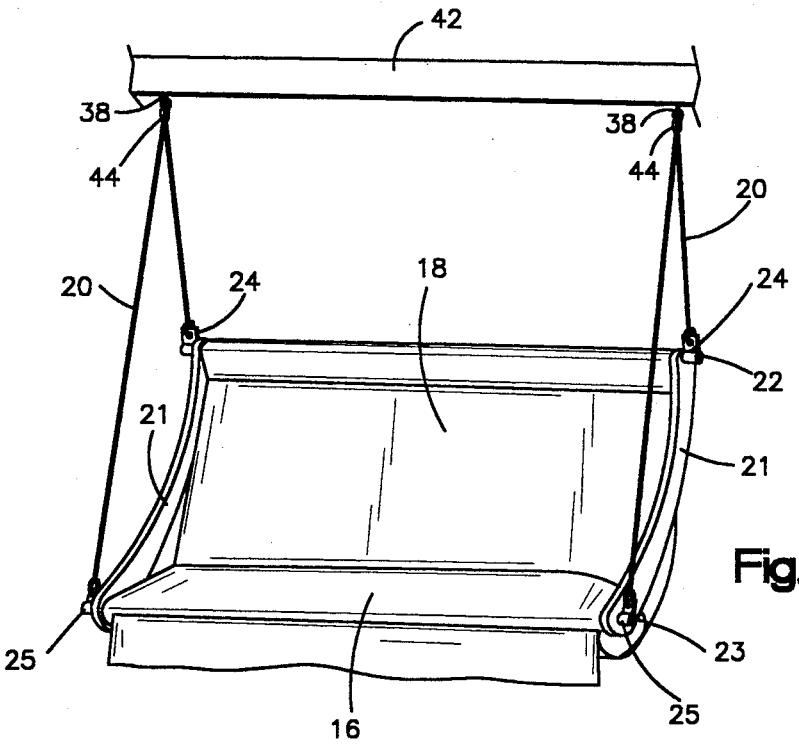
FIG. 2 is a front perspective view of the lounge swing shown in FIG. 1 operatively secured to a permanently secured overhead supporting member.
Figure 3:
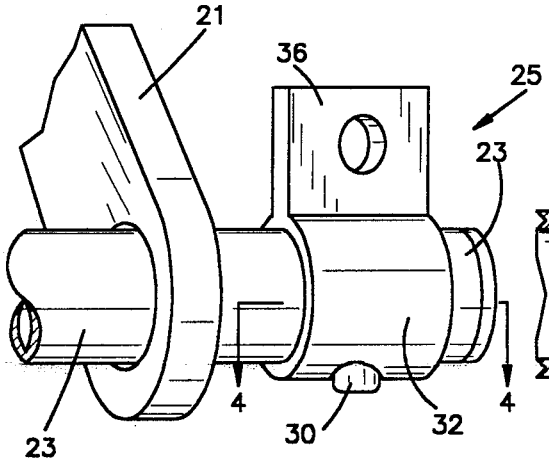
FIG. 3 is an enlarged, front perspective view of one of the snap-on connectors for the lounge swing shown in FIGS. 1 and 2.
Figure 4:
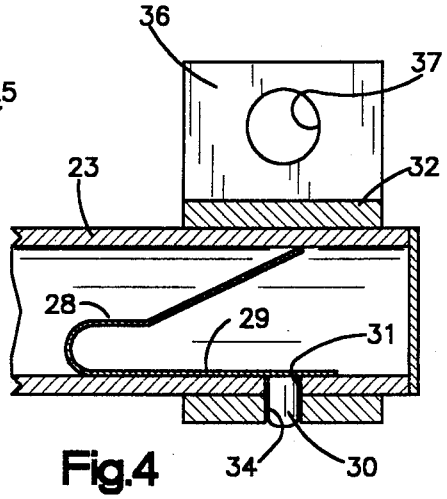
FIG. 4 is a sectional view taken along line 4—4 in FIG. 3.

As shown in FIG. 2, each connecting point for the chains 20 on the understructure for both the lounge seat 16 and the backrest 18 comprises a lateral structural member preferably comprising an upper cylindrical, hollow metal pipe 22 and a lower cylindrical, hollow metal pipe 23 where the distal end of each hollow pipe 22, 23 can be capped as shown in FIG. 4. Laterally spaced, crescent shaped side braces 21 secure each distal end of the upper piper 22 with the respective distal end of the lower pipe 23 to provide both utility as an arm rest and structural reinforcement to the lounge swing 12. The side braces 21 are secured in position on pipes 22, 23 by snap-on connectors. Each terminal end of the upper metal pipe 22 is fitted with a removable snap-on connector 24 while each terminal end of the lower metal pipe 23 contains a similar removable snap-on connector 25. By way of illustration, the lower snap-on connector 25 is viewed in the enlarged perspective view in FIG. 3 and the corresponding sectional view in FIG. 4, which will be described hereinafter in more detail as typical of both upper and lower snap-on connectors 24, 25.

The lower snap-on connector 25 comprises an interior, V-shaped, spring steel member 28 in diametric compression engaging diametrically upper and lower interior surfaces of the hollow lower pipe 23. The spring steel member 28 includes an axially directed lower flat member 29 containing an outwardly extending button 30 protruding radially downwardly through an aligned opening 31 disposed in the lower wall section of the lower pipe 23. The lower snap-on connector 25 further comprises a circular ferrule 32 adapted to provide a sleeve fit over the end of the lower piper 23 where the lower wall portion of the ferrule 32 likewise contains a radially aligned hole 34 to permit the downwardly protruding button 30 to extend through the radially aligned openings 31 and 34 in the lower pipe 23 and surrounding ferrule 32 respectively. The V-shaped spring steel member 28 can be compressed radially inwardly by applying inwardly directed pressure on the protruding button 30 to disengage the ferrule 32 from the lower pipe 23 during disassembly but will securely engage the ferrule 32 in locking engagement with the pipe 23 while in use. Thus, by pushing or compressing the protruding button 30 inwardly, the ferrule 32 can be forced onto the end of the lower piper 23 and moved axially inwardly over the depressed button 30 until the button 30 engages the radially aligned opening in the ferrule 32 to lock the ferrule 32 in a set position on the pipe 23. In a similar manner, the lower snap-connector assembly 25 can be easily released by simply depressing the button 30 and sliding the ferrule 32 axially outwardly over the depressed button 30 until the ferrule 32 is removed from the pipe 23. Both ends of the lower pipe 23 as well as both ends of the upper pipe 22 are fitted with snap-on connectors for easy assembly or disassembly of the lounge swing 12 relative to the overhead supporting structure 14.

As best shown in FIG. 3 and 4, the ferrule 32 includes an exterior upright member 36 containing a through-hole 37 where the upright member 36 is diamerically opposite to the opening 34 in the ferrule 32 lower wall section. The through-hole opening 37 as well as similar through-hole openings in the other snap-on connectors 24, 25 each provide means for interconnecting with the chains 20 which in turn are operatively interconnected to the overhead support structure 14.

As shown in FIG. 1, the overhead support structure 14 can comprise a free-standing, overhead support structure 14 typically useful outdoors but adaptable for use indoors if desired. Alternatively, the lounge swing 12 can be operatively supported by a light weight portable free-standing formed steel tubing structure, or can be operatively supported indoors by an overhead support structure comprising an overhead header beam 42 secured to conventional ceiling beams as shown in FIG. 2. The preferred interconnections to the overhead support structure 14 comprises bearing fitted eye-bolts 38 secured to a center beam member 40 or 42 of the overhead support structure 14. In either overhead structure 14, the eye bolt connectors 38 provide the attachment for chains 20 to the center beam 40 or 42 where hooks 44 on chains 20 provide quick disconnect engagement with the eye of the eye-bolt connectors 38. Suitable eye-bolt connectors can be 5/16 inch or one-half inch eye-bolt tightened with a nut. Preferred eye-bolt connectors 38 contain internal bearing means within the eye of the eye-bolt 38 to engage connecting means 44 on chains 20 and to facilitate transverse swing motion of the lounge swing 12 relative to the stationary overhead support structure 14.

Figure 6:
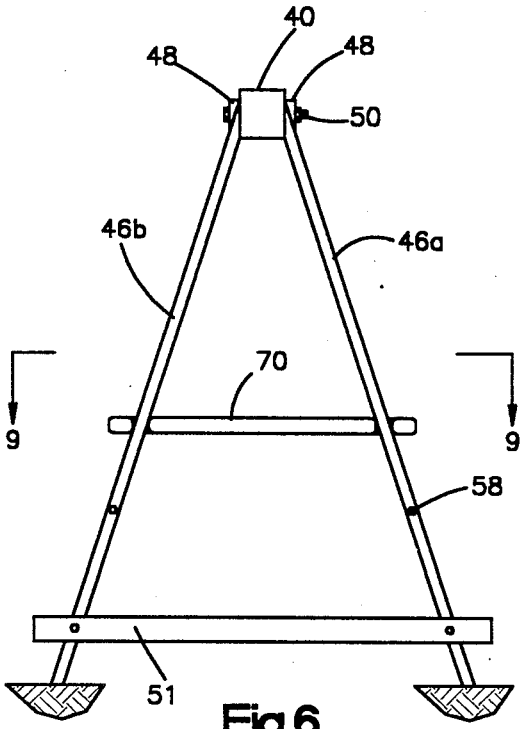
FIG. 6 is a side elevation view showing one side of the free-standing overhead frame shown in FIGS. 5 and 1.
Figure 7:
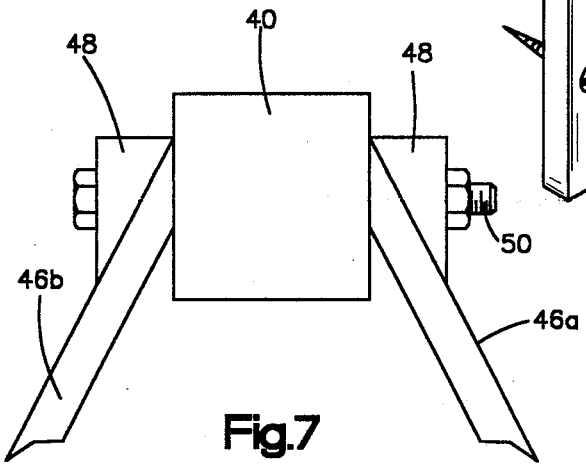
FIG. 7 is an enlarged partial view of FIG. 6 showing a partial, upper side elevation view of the free-standing overhead frame.

Referring now in more detail to the free-standing overhead support structure 14 shown in FIG. 1, four wooden vertical leg members 46, preferably oak, support the center beam 40 where a pair of legs **46*a*, 46*b* support each end of the center beam 40 in an A-frame construction, as best shown in FIG. 6. The A-frame construction comprises a front leg 46*a* and a rear leg 46*b* secured to respective sides of the center beam 40. Both the front leg 46*a* and rear leg 46*b* each have upper distal ends with an angle cut for engaging the flat sides of the center beam 40 at a proper angle relative to the vertical. As best viewed in FIG. 7, each leg member 46*a*, 46*b* is fitted with a complimentary cut external block 48 to provide a square structure with each cut distal end of each leg 46 and thereby provide a squared or right angular securing engagement of a through bolt 50 securing the external blocks 48, the angled cut legs 46, and the center beam 40. Thus, the through bolt 50 is maintained for strength and structural integrity purposes at right angles through the center beam 40. The angle with the vertical is shown in FIG. 7 is about 68°, although other angles are useful and the preferred angle should be between 60° and 75° for optimum stability. Accordingly, the through bolt 50 can be easily fitted through aligned holes in the respective structural members and easily secured with a tightening nut and washer arrangement against the blocks 48. The lower sections of the vertical legs are reinforced by a transverse reinforcing member 51 secured between front leg 46*a* and rear leg 46*b* to complete the A-frame construction as best viewed in FIG. 6**.

Figure 5:
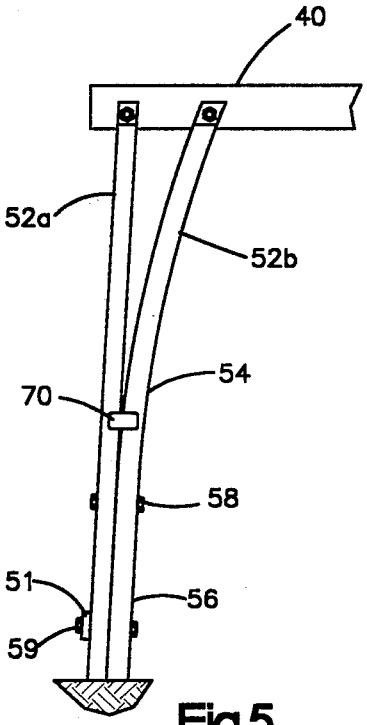
FIG. 5 is partial elevation view showing one of the vertical leg members of the overhead frame shown in FIG. 1.

In a preferred aspect of this invention shown in FIGS. 1 and 5 each vertical leg member 46 contains a laterally split upper section where the upper three-fourths linear length of each leg 46 comprises two split members **52*a* and 52*b* progressively spaced laterally with increasing height to produce a Y-shaped leg 54. In FIG. 1, the lower section of the leg 46 comprises an internal foot section. Instead of the Y-shaped leg 46 having an integral foot as shown in FIG. 1, the foot section 6 of leg 54 can comprise two vertical pieces bolted together in the foot section as shown in FIG. 5. The Y-section of the leg 54 is reinforced along the width and cross-grain with a bolt 58 and an addition through bolt 59 securing both the reinforcing member 51 and the split leg foot 56 to prevent linear splitting of the lower foot section 56. The Y-shape leg 46 with an integral foot shown in FIG. 1 can be readily created by simply cutting a space with the grain to the extent desired. As best viewed in FIG. 5, the split upper distal ends 52*a*, 52*b* are securely bolted or otherwise secured to the center beam 40 in a laterally spaced relationship along the lateral side of the beam 40**.

By way of an illustrative example, each Y-shaped vertical leg member 46 can be oak lumber being about 68 inches in linear height, about three inches wide, and approximately one inch thick with a one-eighth to one-sixteenth inch wide slit disposed three-quarters of the linear length from the top end of the leg 46. Where the leg 54 comprises two vertical oak pieces bolted together in the foot section 56, as shown in FIG. 5, the two vertical oak pieces can each be one and one-half inches wide to provide an overall three inch width. The upper reaches of the split members 52*a*, 52*b* are progressively separated with increased height until the bolt centers of the upper distal ends of the upper split members 52*a*, 52*b* are laterally spaced along the center beam 40 at distances between about six and eight inch centers where a seven inch center distance is preferred. The center began 40 cross-section can be about three inches by seven-eighths inch thick although larger thicknesses can be utilized. The transverse ground distance between the foot sections of legs 46*a* and 46*b* is approximately 48 inches.

Figure 8:
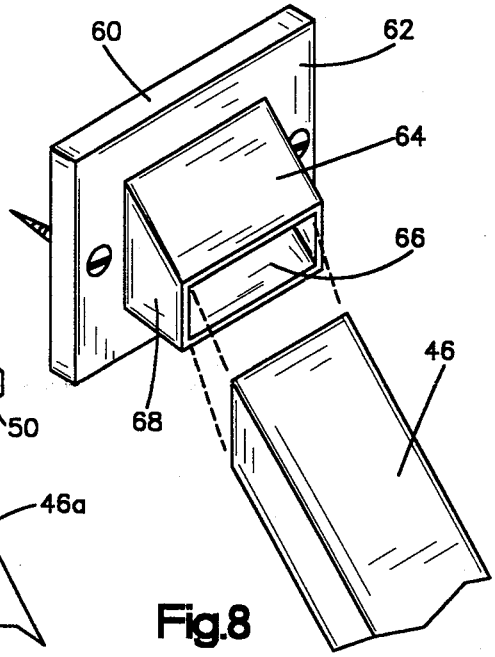
FIG. 8 is a perspective view of a shoe member shown as an alternative method to FIG. 7 for securing leg members.

In a preferred embodiment of this invention, an upper distal end of a vertical leg member 46 or 54 can be secured to the center beam 40 by means of a slip-fit within a metal shoe 60 having a back plate 62 secured to the center beam 40 by wood screws or the like, as shown in FIG. 8. Each metal shoe 60 contains a downwardly angled sleeve insert defined by a downwardly angled upper wall 64 and a parallel downwardly angled lower wall 66 maintained in angled parallel construction by laterally spaced side walls 68 whereby the walls 64, 66, 68 define the downwardly angled sleeve-fit insert or slot within the metal shoe 60. A preferred angle insert within the shoe 60 relative to the vertical is between 60° and 75° for stability purposes and particularly shown to be about a 68° angle in FIG. 8. It is readily seen that leg member 46 and 54 can be easily slip-fitted within the angled sleeve-fit opening and tightly secured therein due to downward forces in use and maintained at the designated angle due the interior wall construction of walls 64, 66, 68. If desired, the leg 46 can be secured within the angled sleeve-fit opening of shoe 60 by a wood screw or the like.

Figure 9:
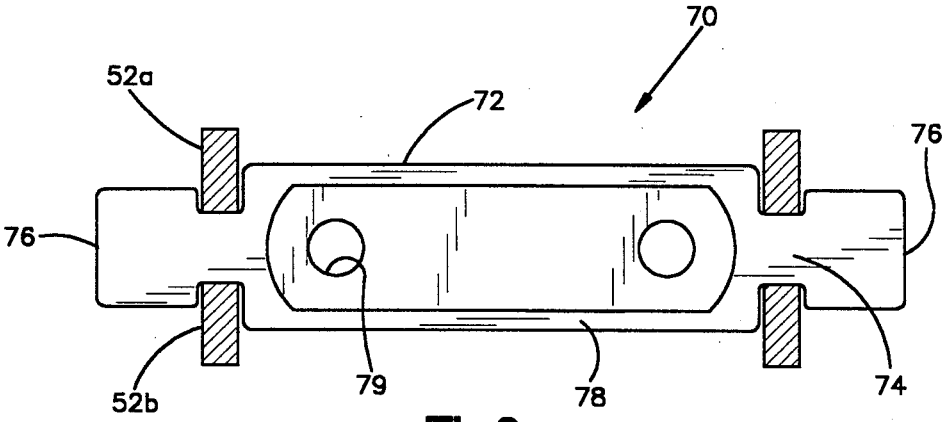
FIG. 9 is a sectional view taken along lines 9—9 in FIG. 6 showing the friction fitted utility shelf secured between the pair of vertical leg members.

In a further preferred aspect of this invention, a pair of vertical legs 46*a* and 46*b*, as viewed in FIGS. 6 and 9, can be fitted with a removable shelf 70 by friction fitting the shelf 70 within the narrowing crotch or fork formed by split members 52*a* and 52*b* in the narrowed Y-shaped leg sections of leg 54 integrating into the foot section 56. It is readily seen that the progressively narrowing slit in the lower part of the Y-shaped sections will securely engage the shelf 70 by forcing the shelf 70 downwardly within the narrowed crotch whereby the shelf 70 is secured by a friction fit between adjacent leg members 52*a*, 52*b*. The breadth of the shelf 70 is coordinated to provide the necessary friction fit as well as the desired shelf height relative to the ground level while the swing 12 is in use.

Shown in FIG. 9 is a preferred plan view configuration of shelf 70 taken along section 9—9 in FIG. 6. The shelf 70 comprises a central elongated flat body section 72 extending outwardly into dumb-bell shaped structures at either end consisting of an intermediate narrowed neck 74 extending into enlarged distal knobs 76. The intermediate narrowed necks 74 are adapted to be forced downwardly into a tight friction fit within the narrowed Y-shaped sections 54 of the front leg 46*a* and the rear leg 46*b* whereby the body section 72 traverses the distance between the front vertical leg 46*a* and the rearward vertical leg 46*b*. The enlarged end knobs 76 and the flat body 72 sections provide further friction engagement in conjunction with the narrowed neck 74 and to prevent traverse movement of the shelf 70. The secured flat shelf70 further provides a horizontal strut structure to the A-frame construction of a pair of vertical legs 46*a*, 46*b* to reinforce and prevent transverse bending moments in the legs 46*a*, 46*b*. The top flat portion of the shelf 70 desirably contains a peripheral raised lip 78 to prevent items resting on the top from slipping off in use along with circular indents or recesses 79 for holding drink containers.

In accordance with this invention, the indoor/outdoor swing assembly10 can be easily and efficiently assembled by snapping on the snap-on connectors 24, 25 to each end of the upper pipe 22 and lower pipe 23 understructures supporting the lounge seat 16. The snap-on connectors 24, 25 are each snapped on by depressing the radially extending button 30 to permit the ferrule 32 slip over the pipe ends 22, 23 whereupon the button engages the hole 34 in the ferrule 32 to secure the ferrule 32 to the pipe ends 22, 23. Preferably the chains 20 can be permanently interconnected to openings 37 in each upright member 36 of the snap-on connectors 24, 25 and the swing 12 can be directly secured to the overhead support structure 14 by merely engaging the upper chain hooks 44 with the laterally spaced eye-bolt 38 secured to the center beam 40 of the free-standing overhead structure 14. The lounge swing 12 can be quickly and easily disconnected from the free-standing structure 14 by merely depressing buttons 30 and removing the snap-on connectors 24, 25 from the swing understructure supporting pipes 22, 23. In a similar manner, the chains 20 can be removed and subsequently interconnected with an indoor beam supporting structure 42 shown in FIG. 2 by again engaging the understructure pipes 22, 23 with the respective snap-on connectors 24, 25. The procedure can be reversed to transfer the lounge swing 12 from indoors to the outdoor free-standing structure 14 or for storage as desired.

Although the portable indoor/outdoor lounge swing and swing assembly have been described and illustrated in the drawings, equivalent structures are contemplated and are not intended to be limited, except by the appended claims.

We claim:

1. A lounge swing assembly consisting of a lounge swing adapted to be operatively interconnected to an overhead supporting structure to permit transverse movement of the lounge swing, the lounge swing assembly comprising:

a lounge swing having a seat and a backrest supported by an understructure, the understructure including at least two lateral supporting pipes, each lateral supporting pipe having a hollow distal end at both ends of each lateral supporting pipe, and having a pipe wall where each distal end is fitted with a removable snap-on connector and each hollow distal end contains a radially directed opening in the pipe wall adapted to engage said snap-on connector;

each snap-on connector comprising a ferrule member slip fitted around the respective exterior distal end of the supporting pipe and a corresponding interior spring steel member adapted to compressively engage the interior of the respective hollow distal end of each supporting pipe, where the spring steel member interacts with the respective ferrule member to provide snap-on connection to said supporting pipe;

where each said ferrule member includes a lower ferrule wall and contains a radial opening in the lower ferrule wall radially aligned with the radial opening in said respective hollow end of said supporting pipe, where each said respective interior spring steel member comprises a V-shaped spring steel member having an upper member and a lower member compressively engaging the upper interior surface and the lower interior surface of the respective hollow distal end of the lateral supporting pipe, the lower member of the spring steel member being secured thereto a downwardly depending button adapted to be radially aligned within the radially aligned opening in the lower pipe wall and the radially aligned opening in the lower ferrule wall whereby said button aligned within said openings securely locks said snap-on connector to the respective distal end of said lateral pipe, said button adapted to be compressed radially inwardly substantially free of the radially aligned opening in said respective ferrule whereby the respective ferrule can be laterally removed from or slipped onto the respective distal end of the lateral pipe;

each said ferrule containing an upright member adapted to interconnect with a supporting chain, and a plurality of supporting chains where each chain connects with a respective upright member on respective snap-on connectors, and said supporting chains are adapted to operatively interconnect overhead to a support structure to permit transverse swinging movement of the lounge swing.

2. The lounge swing assembly in claim 1 where each snap-on connector contains a V-shaped spring steel member having an axially disposed lower member orientated in the axial direction within the respective hollow distal end of each pipe.

3. The lounge swing assembly in claim 1 where the upright member of each ferrule contains a through-opening for interconnection to the supporting chains.

4. The lounge swing assembly in claim 1 where the understructure contains two lateral supporting pipes and each distal end thereof is fitted with one said removable snap-on connector.

5. The lounge swing assembly in claim 1 where the lounge swing is operatively interconnected to an overhead support structure.

6. The swing assembly in claim 5 where the overhead support structure comprises a permanently secured indoor beam.

7. The swing assembly in claim 5 where the overhead support structure comprises a free-standing support structure.

8. The swing assembly in claim 7 where the free-standing support structure is portable.

9. The swing assembly in claim 5 where the operative interconnection with the overhead structure comprises permanently secured eye-bolts secured to the overhead structure.

10. The swing assembly in claim 9 where the eye-bolts include internal bearing means to facilitate transverse swinging movement of the lounge swing.

11. The swing assembly in claim 1 where the lounge swing is operatively interconnected to a free-standing overhead support structure comprising a center beam member supporting the lounge swing, and said center beam member is supported by a pair of transversely spaced A-frame leg members.

12. The swing assembly in claim 11 where each pair of A-frame leg members comprises a front leg and a rear leg vertically disposed, where each leg has upper distal ends each secured to the center beam member, and where lower sections of the front and rear legs are secured by a transverse member to provide the A-frame construction.

13. The swing assembly in claim 12 where each vertical leg member forms an angle with the vertical between about 60° and 75°.

14. The swing assembly in claim 13 where each upper distal end of each vertical leg is cut at said angle to engage the respective surface of the center beam, where each upper distal end is fitted with an exterior complimentary block to provide a square surface, and a securing bolt secures the exterior blocks and upper distal ends of the legs to the center beam and transverses the center beam member at a right angle to the center beam member.

15. The swing assembly in claim 12 where the front leg member and the rear leg member of the A-frame construction are secured to the center beam member by means of a performed metal shoe secured to the center beam where each said metal shoe contains a downwardly angled sleeve insert adapted to receive and engage the upper distal end of each respective leg member.

16. The swing assembly in claim 15 where the downwardly angled insert forms an angle between 60° and 75° relative to the vertical.

17. The swing assembly in claim 12 where each vertical leg member comprises a laterally split upper section to provide a Y-shaped vertical leg.

18. The swing assembly in claim 17 where each Y-shaped leg member comprises upper laterally split members progressively spaced laterally with increasing height, and where the bottom foot portion of the Y-shaped leg remains integral.

19. The swing assembly in claim 18 where the upper distal ends of each upper laterally split members are secured to the center beam member in a laterally spaced relationship along the lateral side of the beam.

20. The swing assembly in claim 19 where the laterally spaced relationship between secured upper laterally split members comprises between about six and eight inch centers between the laterally split members.

21. The swing assembly in claim 18 where each vertical leg member has the upper laterally split members secured to the center beam by means of a metal shoe for each upper split member, where each metal shoe contains a downwardly angled sleeve insert adapted to receive and engage the upper distal end of each respective upper split member.

22. The swing assembly in claim 21 where the metal shoe contains a downwardly angle sleeve insert having an angle between about 60° and 75° relative to the vertical.

23. The swing assembly in claim 18 where each Y-shaped leg member forms a narrow fork section formed by the upper split members integrating into the integral bottom portion, where the swing assembly includes a removable transverse shelf secured by friction within the narrowed fork section of the Y-shaped leg member, and the shelf is secured between a front and rear leg forming the A-shaped construction.

24. The swing assembly in claim 23 where the removable flat shelf comprises an elongated central flat body extending outwardly into dumb-bell shaped structures at each end adapted to engage the narrowed fork sections of the front and rear legs respectively.

25. The swing assembly in claim 24 where each dumb-bell structure comprises an intermediate narrowed neck extending into outer enlarged distal knobs.

26. The swing assembly in claim 1 where the lounge swing contains a pair of laterally spaced, crescent shaped side braces each attached to the upper supporting pipe and the lower supporting pipe, said side braces locked in place by said snap-on connectors to provide arm rests and supporting braces to the lounge swing.

27. The swing assembly in claim 17 where each Y-shaped leg member comprises upper laterally split members progressively spaced laterally with increasing height and the bottom foot portion thereof comprises adjacently secured members.

28. A method of assembling a lounge swing adapted to be interconnected to an overhead supporting structure to permit transverse movement of the lounge swing, the method comprising:

providing a lounge swing having a supporting understructure comprising at least two lateral supporting pipes, each pipe having distal pipe ends and a lower wall; and each distal end of each said supporting pipe being hollow and having a radially directed opening in the lower wall of each pipe end, where each distal pipe end contains an interior spring steel member compressively engaging the interior of the respective hollow pipe ends where said spring steel member contains a downwardly depending button protruding through the opening in the hollow pipe end;

slipping onto each distal pipe end a snap-on connector adapted to interact with said interior spring steel member and comprising an outer ferrule a lower wall,and having a radial opening in the lower wall of the ferrule adapted to be radially aligned with the opening in the lower wall of the respective pipe end;

compressively engaging the downwardly depending protruding button to permit the ferrule to pass over the respective distal pipe end radially aligning the ferrule opening with the opening in the hollow pipe end, and permitting the compressed depending button to expand radially outwardly to engage the ferrule member and thereby lock the snap-on connector to the respective hollow pipe end;

connecting supporting chains to each snap-on connector where the supporting chains are adapted to interconnect with an overhead supporting structure.

29. The method in claim 27 where the lounge swing is interconnected to a free-standing, overhead supporting structure, the overhead supporting structure provided comprising a center beam supported by a pair of transversely spaced A-frame leg members, where each leg member comprises laterally split upper members secured to the center beam to provide a Y-shaped vertical leg.

30. The method in claim 28 where a pair of vertical legs consisting of an A-frame structure of a front leg and a rear leg, where a removable flat utility shelf having enlarged end knobs adapted to secure the shelf is inserted with narrowed Y-sections of each leg to secure said shelf between said front and rear legs.

* * * * *